United States Patent [19]

Meywald

[11] 4,079,233

[45] Mar. 14, 1978

[54] HEATING ELEMENT FOR ELECTRICAL APPLIANCES HAVING A BLOWER

[75] Inventor: Klaus Meywald, Kandel, Germany

[73] Assignee: Firma Fritz Eichenauer, Germany

[21] Appl. No.: 648,764

[22] Filed: Jan. 13, 1976

[30] Foreign Application Priority Data

Jan. 22, 1975 Germany ..... 2502406

[51] Int. Cl.[2] ..... H05B 3/02; H01C 3/10; H01C 1/082; F24H 3/04

[52] U.S. Cl. ..... 219/375; 219/381; 219/532; 219/538; 338/58; 338/290; 338/318

[58] Field of Search ..... 219/370, 369, 374–376, 219/381, 382, 532, 536, 538; 34/243 R, 96–101; 338/53–58, 280–282, 283–284, 287–291, 294, 304, 305, 315, 317, 318–321

[56] References Cited

U.S. PATENT DOCUMENTS

| | | | |
|---|---|---|---|
| 2,170,174 | 8/1939 | Wiegand | 219/367 X |
| 2,834,867 | 5/1958 | White | 338/290 X |
| 3,691,348 | 9/1972 | Kunz | 338/318 X |
| 3,912,903 | 10/1975 | Northrup | 338/282 X |

FOREIGN PATENT DOCUMENTS

| | | | |
|---|---|---|---|
| 1,407,218 | 6/1965 | France | 219/370 |
| 1,440,404 | 1/1969 | Germany | 219/374 |

*Primary Examiner*—A. Bartis
*Attorney, Agent, or Firm*—Craig & Antonelli

[57] ABSTRACT

A heating element for an electrical appliance having a blower (e.g. a fan heater or a hair drier) comprises a wire looped in linear formation (e.g. zig-zag or sinuous) the loops being held in position by support plates so that there are at least two loop rows transverse to the air flow direction and disposed in succession in that direction and so that the loops in one of those rows are placed opposite to gaps in the other. In an element having four loop rows with a center taping for two-stage power control the electrical connections are disposed on only one support plate with the center tapping connection at the same side of the plate as the means supply connections; also, the loops in a first pair of rows are aligned with one another and are offset from the loops in the second pair which are also aligned with one another.

7 Claims, 4 Drawing Figures

HEATING ELEMENT FOR ELECTRICAL APPLIANCES HAVING A BLOWER

The invention relates to heating elements for electrical appliances having a blower, such as fan heaters, hair driers or the like, the heating element comprising a resistance heating wire which is looped in linear formation, for example zig-zag or meander (sinuous) formation, with a plurality of rows of loops disposed in succession transversely of the flow direction of the air and having support plates which are disposed parallel to the flow direction of the air and which secure the rows of loops in position.

Heating elements of such construction are known (e.g. from German Patent specifications Nos. 1,185,743 and 1,256,335). Because of their favourable thermal and electrical behaviour and also their self-supporting properties, these heating elements have proved satisfactory and are primarily employed in space heaters, hair driers or the like. The rows or series of loops, advantageously six rows in succession with two-stage power control, are in this case so arranged in positions congruent with one another relatively to the flow direction of the air that the loops of each row are aligned with the corresponding loops of the adjacent-rows parallel to the flow direction of the air.

Tests have shown that, in the operation of heating elements of this construction, it is not readily possible to increase the heating capacity, for example, either by increasing the number of rows of loops connected in series, or by increasing the electrical power with the number of loop rows and the blower output remaining the same, because the flow resistance acting against the flowing air becomes so great that the increased heating power can no longer be discharged to the air flowing past. In this case, the increased heating power can only be discharged as heat radiation, and therefore the flow resistance is, to a very strong degree, dependent on temperature. The efficiency of such a heating element, namely the power delivered as heat to the flowing air per unit of electrical power, is therefore highly dependent on the value of the flow resistance because, if the flow resistance becomes too great, much of the heat which is generated electrically can only be discharged as infrared radiation.

An object of the invention is to reduce the flow resistance in operation of heating elements of the kind initially referred to above, having given external dimensions, and thus to improve the efficiency thereof.

To this end, according to the invention, the loops of different loop rows are offset relatively to one another transversely of the flow direction of the air. The offset is such that the tips of the individual loops in one row are placed opposite to gaps between the loops of another row and vice versa. Surprisingly, it is found that with such an arrangement, to which one would attribute a greater flow resistance because of the larger number of items disposed across the air flow direction in the flow duct, the flow resistance, when the heating element is in operation, that is to say, has heated loops, is smaller than is the case with the known heating elements according to the appropriate prior art. Therefore, the efficiency of such heating elements is improved by this feature according to the invention.

According to one preferred constructional form, the loops of two adjacent rows are in alignment in the flow direction and are offset from the loops of other rows.

In an alternative constructional form, the loops of adjacent rows are offset from one another.

Instead of the six rows of loops hitherto necessary with a two-stage construction, a heating element according to the invention requires only four rows of loops, which corresponds to a total saving as regards cost for material and assembly of about 40%, while having the same output and with a flow resistance which at least does not become greater. Furthermore, the construction of the heating element with only four rows of loops permits a subdivision into two groups of rows disposed in succession, the individual loops in the rows within each group being in alignment relatively to the air flow direction, and the loops of different groups being, however, offset transversely of the air flow direction.

It is possible, in connection with a heating element having only four rows of loops for a centre tapping on the loops, provided for controlling the power output, to be disposed at the same side of the support plate as that to which the mains voltage supply leads are also secured. This facilitates the assembly of the heating element itself and the fitting thereof in other appliances, since the cable of the centre tapping does not have to be led back to the other side. With heating elements having six rows of loops, on the contrary, the mains voltage supply leads and the centre tapping are always secured to different sides of the support plate.

These and other features, details and advantages of the invention will be apparent from the following description of an embodiment thereof and also from the drawing, wherein.

Figure 1:
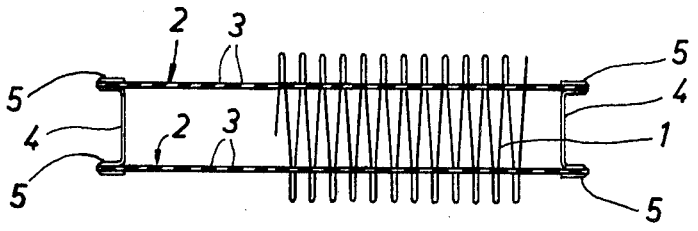
FIG. 1 shows a heating element in a partially cut away longitudinal view.
Figure 3:
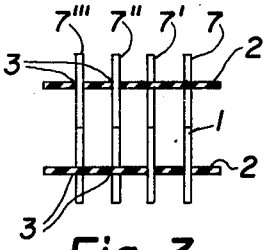
FIG. 3 is a side cross-sectional view of the heating element in FIGS. 1 and 2.

Referring to the drawing, the heating element illustrated comprises essentially a resistance heating wire 1, which is looped in zig-zag or sinuous linear formation. The loops are arranged in rows in several successive planes, only one row being partially shown in FIG. 1. The necessary three-dimensional rigidity is provided for the resistance heating wire 1 by two support plates 2 which are disposed parallel to one another and are formed with rows of holes 3 (four rows in the illustrated example, as may be seen in FIG. 3). These support plates are fitted from both sides on to the preformed loops and are pushed on to these latter for a certain distance. As a result, the two wires of each loop fit in a respective one of the holes 3.

The two support plates 2 are connected to one another by spacer members 4, for example, in the form of sheet metal strips; in the constructional example illustrated, these strips engage by means of a U-shaped portion 5 around the support plates 2, which are rectangular, on their narrow sides.

Figure 2:
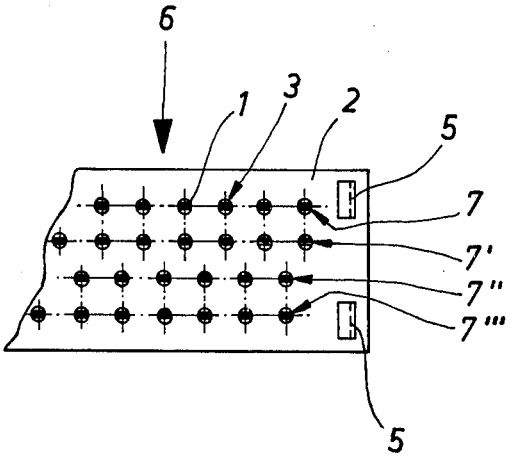
FIG. 2 shows the heating element according to FIG. 1 in a fragmentary plan view.

It can be seen from FIG. 2 that the four rows of loops 7, 7',7'', *7'''* are disposed in succession relatively to the flow direction of the air indicated by the arrow 6 and are arranged in pairs 7, 7' and 7'',7''', respectively, each pair being congruent or having the loops of one row in alignment with those of the other. The respective pairs of loop rows are offset relatively to one another transversely of the flow direction of the air which is indicated by the arrow 6, so that gaps in the rows 7'', 7''' are opposite to the loops of the rows 7, 7', and vice versa.

Figure 4:
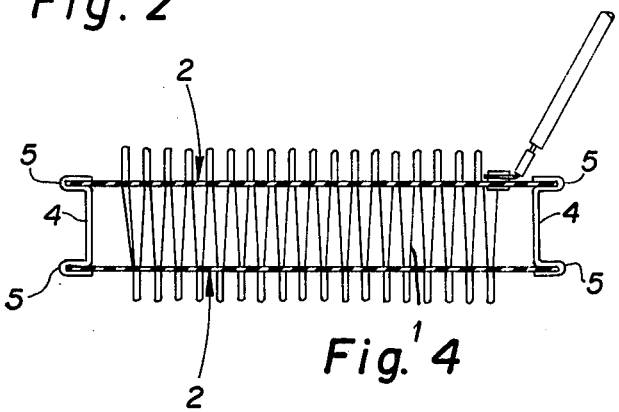
FIG. 4 is a view of the heating element, as shown in FIG. 1, with the electrical supply connections being illustrated.

The arrangement of the loops of wire 1 may conveniently be such that electrical supply connections illustrated in FIG. 4 are disposed on only one of the support plates 2, including mains voltage supply connections, which may connect the ends of the heating wire 1 in the first row 7 and the fourth row 7'''; and, if desired, a centre tapping, which may connect a loop at the end of the second row 7' or third row 7'', and is adjacent to the voltage supply connections.

I claim:

1. In a heating element for electrical applicances having a blower for discharging air through said heating element, said heating element comprising a resistance heating wire wound in a zig-zag linear row formation disposed in a single plane, wherein a plurality of said linear row formations are disposed in succession transversely of the discharged air flow from said blower, and two spaced supporting plates disposed parallel to said air flow for supporting said pluarlity of linear row formations, wherein loops of each zig-zag of each linear row formation are secured to respective ones of said two supporting plates, the improvement comprising at least two pairs of said linear row formations being disposed in succession, said linear row formations being aligned within each of said two pairs, and each of said two pairs of linear row formations being offset with respect to one another transversely to said air flow.

2. A heating element according to claim 1, wherein the aligned loops of each linear row formation of one of said two pairs are offset from the aligned loops of each linear row formation of the other of said two pairs.

3. A heating element according to claim 2, wherein only two pairs of said linear row formations are disposed in succession.

4. A heating element according to claim 3, wherein voltage supply leads and a tap for power output control are provided on said supporting plates, all connections being disposed on only one of said two supporting plates.

5. A heating element according to claim 1, wherein only two pairs of said linear row formations are disposed in succession.

6. A heating element according to claim 1, wherein voltage supply leads and a tap for power output control are provided on said supporting plates, all connections being disposed on only one of said two supporting plates.

7. A heating element according to claim 1, wherein said resistance heating wire is a single continuous straight wire wound in said zig-zag linear row formation in said single plane.

* * * * *